United States Patent [19]

Mitchell

[11] Patent Number: 4,729,820

[45] Date of Patent: Mar. 8, 1988

[54] MULTIELECTROLYTE SHEAR TREATMENT OF CARBON FIBERS

[75] Inventor: Stuart Mitchell, North Ridgeville, Ohio

[73] Assignee: Amoco Corporation, Chicago, Ill.

[21] Appl. No.: 13,683

[22] Filed: Feb. 11, 1987

Related U.S. Application Data

[63] Continuation-in-part of Ser. No. 868,737, May 30, 1986, abandoned.

[51] Int. Cl.[4] ..... C25F 5/00

[52] U.S. Cl. ..... 204/130; 204/28

[58] Field of Search ..... 204/130, 28

[56] References Cited

U.S. PATENT DOCUMENTS 3,832,297 8/1974 Paul ..... 204/129.75

*Primary Examiner*—R. L. Andrews

*Attorney, Agent, or Firm*—Richard J. Schlott; William H. Magidson; Ralph C. Medhurst

[57] ABSTRACT

Carbon fibers subjected to an electrolytic treatment in an oxidizer bath followed by electrolytic treatment in an ammonium bath have surface elemental content of oxygen greater than 7% and nitrogen greater than 4%. Composites based on the carbon fiber in combination with bis-maleimide type matrix resins have improved toughness and interfacial bonding.

9 Claims, No Drawings

MULTIELECTROLYTE SHEAR TREATMENT OF CARBON FIBERS

CROSS-REFERENCE TO RELATED APPLICATIONS

This application is a continuation-in-Part of U.S. application Ser. No. 868,737, filed May 30, 1986 now abandoned.

BACKGROUND OF THE INVENTION

This invention relates to a process for electrolytically treating the surface of carbon fibers. More particularly, the invention relates to surface-treated carbon fibers and to an electrolytic process for surface-treating carbon fibers. The invention further relates to composites comprising the improved fibers and a bis-maleimide matrix resin having improved mechanical properties.

Strength properties of composite materials and their permanence in adverse environments depend on the strength of the interfacial bonding between the carbon fiber and the resin matrix components. A variety of methods for improving the interfacial bonding are known and are widely available in the fiber art. For example, U.S. Pat. No. 3,671,411 to Ray et al. discloses subjecting a carbon or graphite fiber to an electrolytic reaction in an aqueous electrolyte whereby negative ions are attracted to the surface of the fiber acting as anode, thereby modifying the fiber surface.

U.S. Pat. No. 4,401,533 to Saito et al. discloses electrolytically surface-treating carbon fibers in an aqueous solution of a sulfuric acid salt, passing a current through the fiber at a specified range of current density, while continuously moving the carbon fiber as an anode in the aqueous electrolytic solution.

U.S. Pat. No. 3,832,297 to Paul, Jr. discloses an electrolytic process for surface treating graphite fibers using organic and inorganic ammonium compounds dissolved in water. These compounds are said to decompose substantially completely to gaseous products on heating at temperatures below about 250° C. Illustrative ammonium compounds are stated to include ammonium hydroxide, ammonium carbonate, ammonium bicarbonate, ammonium benzoate, ammonium dithionate, ammonium hydrosulfide, ammonium sulfite, ammonium thiosulfate, and ammonium tartrate.

Although these and other related processes appear to afford some improvement in interfacial bonding, the art continues to have need of composites with still better bonding.

SUMMARY OF THE INVENTION

The present invention is a surface-treated carbon fiber and method for making a carbon fiber wherein the fiber is subjected to an electrolytic treatment using a particular sequence of electrolytes. The surface-treated carbon fibers are useful in making composites having good mechanical properties, improved toughness and resistance to stress-induced cracking as reflected by increased edge delamination strength (EDS).

DETAILED DESCRIPTION OF THE INVENTION

The surface-treated carbon fibers of this invention are prepared by the method comprising the steps of:

(a) moving said fiber, as anode, through a first electrolytic bath comprising an aqueous solution of an oxidizer which may be acid, base, or neutral salt, followed by (b) moving said fiber, as anode, through a second electrolytic bath comprising an aqueous solution of an ammonium compound, said bath having a pH of at least about 8.

The carbon fibers that may be treated by the process of this invention include carbon and graphite fibers in the generic sense. More specifically, the term carbon fibers includes fibers prepared by heating polymeric materials such as polyacrylonitrile, polyvinyl alcohol, pitch, natural and regenerated cellulose and the like in fiberous form to carbonizing or graphitizing temperatures. Although carbon fibers may be treated in the process of this invention in the form of individual monofilament, as a practical matter the fiber will be treated in the form of multifilament yarn or tow for convenience in handling and subsequent fabrication. The process of this invention may also have application for treatment of carbon fiber in the form of woven and non-woven fabrics, mat, felt and the like.

The first aqueous electrolytic bath (herein also referred to as an "oxygen bath") comprises an aqueous solution of an oxidizer. The oxidizer may be any water-soluble electrolyte which during electrolysis generates oxygen at the surface of the anode, i.e., the carbon fiber being treated, thereby introducing oxygen functionalities on the fiber surface. Although the form of the oxygen functionality is unknown, the presence may be determined by measurement of the elemental oxygen content of the surface. Preferred oxidizers include mineral acids such as phosphoric acid, nitric acid, sulfuric acid and the like, alkali metal hydroxides including lithium hydroxide, sodium hydroxide, potassium hydroxide and the like, and the neutral salts thereof such as sodium sulfate, lithium sulfate and the like, as well as neutral salts of other strong oxygen acids like sodium perchlorate, and sodium tetrafluoroborate. For practical applications, the electrolyte bath will comprise concentrations of oxidizer generally from about 0.05 to about 20, preferably from 1 to 10 weight percent.

In the second electrolytic bath (herein also referred to as an "ammonium bath") any water-soluble ammonium compound giving an alkaline solution in water, i.e., a pH of at least about 8, will be useful. Preferred are ammonium hydroxide and ammonium bicarbonate. Electrolysis in the presence of ammonium compounds increases the nitrogen content of the carbon fiber surface. It is believed that such processes modify the carbon fiber surface by introducing the nitrogen in the form of—$NH_2$ functionalities. The concentration of ammonium compound used in the practice of this invention will be that sufficient to increase the nitrogen content of the carbon fiber surface, as determined by measurement of elemental nitrogen content of the surface. Generally the practical concentration for the ammonium compound will lie in a range of from about 0.02 Molar (M) to about 5 M, preferably about 0.05 M to about 3 M. The ammonium bath may further include an auxiliary electrolyte such as for example a neutral salt or an alkali metal hydroxide to increase conductivity in the ammonium bath. Such auxiliary electrolytes may be used in any convenient concentration, and preferably between about 0.01 M and 0.5 M.

The electrolytic process is conducted by impressing a potential or voltage upon the fiber in each cell of the system. The voltage is not narrowly critical and may be adjusted to give a current density between about 0.5 and 5 milliamperes per square centimeter (mA/cm$^2$) of fiber surface area. Generally, the voltages employed in each bath will lie in the range of from about 5 and to about 80 volts.

Bath temperatures are not narrowly critical and will lie in the range of about 5° C. to 50° C., the prevailing ambient (room) temperature or below being most preferably employed.

Voltage, current density, and residence time may be advantageously manipulated to expose the fiber to a total charge of from about 4 to 100 coulombs/gm, preferably about 7 to about 20 coulombs/gm. Using the general ranges of current density and voltage noted above, residence times between about 0.05 and about 1 minute are generally sufficient to achieve exposure to a charge within these ranges. Depending on practical bath lengths through which the tows are fed, usually a length between about 1 and about 15 feet, line speeds of up to about 40 ft/min. are entirely feasible.

Carbon fiber treated by the two-bath process of the invention will be surface-modified to have an increase in both oxygen and nitrogen functionality. The elemental oxygen and nitrogen contents of the carbon fiber surfaces may be determined by Electron Spectroscopy for Chemical Analysis (ESCA), an analysis tool well known and widely used in the chemical arts. The process provides the ratio of the numbers of atoms of various elemental species present at the sample surface. In general, the elemental oxygen present at the surface of the fiber will be greater than about 7%, while the elemental nitrogen will be greater than about 4%.

The present invention provides carbon fiber that, when combined with a matrix resin to form a composite, possesses improved mechanical properties and property retention compared with fiber produced by treatments carried out using either of the baths alone. Also surprising is the fact that electrolytically treating carbon fibers in the reverse bath sequence to that described herein above results in no improvement in composite properties over the properties that result from using an oxygen bath alone.

The improved composites comprise surface-treated carbon fibers of this invention and a thermosetting bismaleimide resin composition. Thermosetting bis-maleimide resin compositions suitable for these purposes are widely known in the art. Generally, these formulations comprise N,N'-bis-maleimides and polymanizable coreactants.

Any of the bis-maleimides commonly employed in matrix resin formulations for fabricating composites may be employed for these purposes. Examples of preferred bis-maleimides include 4,4'-bismaleimido diphenyl methane, and 1,6'-bismaleimido-(2,2,4-trimethyl)hexane, as well as eutectic mixtures of these compounds with 2,4-bismaleimido toluene. Also useful are any of the bis-maleimides disclosed in commonly assigned copending application Ser. No. 565,400 filed Dec. 22, 1983, which is herein incorporated by reference.

Liquid coreactants useful for these purposes include polymerizable liquid vinyl compounds, allylic compounds, acrylate compounds and the like. Examples of suitable liquid coreactants include 0,0'-diallylbisphenol A, N-vinyl-2-pyrrolidone, triallyl isocyanurate, divinyl benzene, and ethylene glycol dimethacrylate. Also useful for these purposes are the epoxy resins containing one or more epoxy groups ordinarily and conventionally found useful in such applications including polyglycidyl compounds and epoxidized dienes and polyenes. Formulations based on epoxy resins may additionally include aromatic diamine hardeners, as well as an accelerator to increase the rate of cure, as is conventionally practiced in the composite art. Still other coreactants that may be used include the well known polymeric imide compounds containing one or more cyanate ester groups.

The bismaleimide thermosetting resin compositions ordinarily include between about 1 and about 99 weight percent, preferably 20–98 percent of bismaleimide; 1 to about 60 weight percent, preferably 3 to 40 percent of one or more liquid coreactants; and 1 to about 40 percent, preferably 2 to 30 percent of other additives such as for example thermoplastic polymers, pigments, fillers, inhibitors, initiators and the like as is commonly practiced in the art. The amount of carbon fiber in such composites will be from about 10 to about 90 percent by weight, preferably about 20 to about 85 percent by weight.

The matrix resin will ordinarily be combined with the surface-treated carbon fibers of this invention to make a preimpregnated reinforcement or prepreg, using any of the several techniques known in the art. Composites may be prepared from the prepreg using heat and, optionally, pressure. Laminates may also be prepared via wet layup followed by compression molding, resin transfer molding, or by resin injection. The composites prepared using the surface-treated carbon fiber of this invention may be used as aircraft parts such as wing skins, wing-to-body fairings, floor panels, flaps, radomes; as automotive parts such as driveshafts, bumpers, and springs; and as pressure vessels, tanks and pipes. They are also suitable for protective armor on military vehicles and sporting goods applications such as golf shaft, tennis rackets, and fishing rods.

The practice of this invention will be better understood by consideration of the following illustrative examples.

EXAMPLES 1 and 2

Fiber Treatments

Unsized and unshear-treated carbon fiber tows having about 12000 fibers/tow, obtained from Union Carbide Corporation under the trade designation T-300, were electrolytically treated. The electrolytic baths were an aqueous, 0.5 M nitric acid bath and an aqueous 2.65 M ammonium hydroxide bath. Untreated fiber tow was used as the control fiber. The treatment conditions used for Examples 1 and 2 are summarized in Table I together with single bath control Examples A and B.

The fiber tow was evaluated after each treatment by ESCA measurement of surface elemental oxygen and surface elemental nitrogen. These results are also summarized in Table I, expressed as % of the overall elemental content of the surface.

COMPOSITE FABRICATION

Composites were made using a bis-maleimide matrix resin consisting of a mixture of 54 parts by weight of methylene dianiline bismaleimide and 46 parts by weight of 0,0-diallylbisphenol A. The composites were fabricated by laying up ten plies of prepreg made by a hot melt process. The four centermost plies contained T-300 carbon fiber having a fiber area weight of about 145 gm/m$^2$. The six outer plies (three on each side of the four center plies) were made with T-40 carbon fiber (available from Union Carbide Corporation) having a fiber area weight of about 136 gm/m$^2$. All composites were autoclave cured and the resin was bled to give a nominal cured composite fiber volume loading of 60%. The composites were for edge delamination strength (EDS) tested both as made and after drying. The EDS tests were carried out by the standardized test method used in the composites industry. The test results are summarized in Table II.

TABLE I

| Example | Electrolyte | **Process Conditions Level (c/g) | Speed (ft/min) | I (amps) | ESCA O (%) | N (%) |
|---|---|---|---|---|---|---|
| Control A | None | — | — | — | 4.2 | 2.3 |
| Control B | $HNO_3$ | 9.8 | 5 | 0.2 | 10.9 | 1.9 |
| Control C | $NH_4OH$ | 16.4 | 2 | 0.3 | 6.8 | 3.8 |
| 1* | $HNO_3$ | 4.9 | 10 | 0.2 | 8.2 | 1.8 |
| | $+NH_4OH$ | 8.2 | 4 | 0.3 | 7.2 | 4.6 |
| 2* | $HNO_3$ | 9.8 | 5 | 0.2 | 12.0 | 1.0 |
| | $+NH_4OH$ | 16.4 | 2 | 0.3 | 7.8 | 7.6 |

*Two separate baths, in the indicated order.

**Level = total treatment, coulombs/gram; speed = carbon fiber line speed, feet per minute; I = bath current, amperes.

It will be apparent from a consideration of the data presented in Table I that the two-bath electrolytic process of this invention, Examples 1 and 2, will provide carbon fiber having, in combination, a surface oxygen and a surface nitrogen level greater than the levels that result by using either bath alone (Control Examples B and C). A separate control example was carried out using the baths in reversed order so that the ammonium bath preceded the oxygen bath and otherwise employing the concentrations and conditions of Example 2. The nitrogen and oxygen levels of the carbon fiber produced in this manner were substantially equal to the fiber produced in Control Example B, demonstrating that the bath order is an additional critical parameter.

Although the method is described in terms of a sequential two-bath process in which the oxidizing first step is immediately followed by the second step using the ammonium bath, it is feasible to carry out the two treatments over a period of time. For example, a carbon fiber electrolytically treated using an aqueous sulfuric acid bath and then dried and stored for several days, was subsequently treated by electrolysis using an ammonium bath, substantially as described above. The surface-treated fiber had oxygen and nitrogen contents by ESCA of greater than 8% and greater than 6%, respectively. It will also be apparent that additional oxidizer baths and/or ammonium baths may be used in practicing the process of this invention. However, as set forth above, it is necessary that treatment in the oxidizer baths precede treatment in the ammonium baths, inasmuch as treatments in which the oxidizer bath follows the ammonium bath lowers the surface nitrogen content of the fiber. Thus, treating the sulfuric acid-treated fiber described above first with in an ammonium bath and then in a nitric acid bath elevated the oxygen content to greater than 17%, but decreased the nitrogen content to less than 3%. Similar results were observed when sulfuric acid was used in the final bath.

TABLE II

| | Edge Delamination Strength As Made K Psi | Dried 16 hr/180° F. K Psi |
|---|---|---|
| Control A | 21.5 | 18.7 |
| Control B | 40.1 | 33.3 |
| Control C | 40.1 | 38.6 |
| Example 1 | 44.4 | 42.1 |
| Example 2 | 47.7 | 40.0 |

Carbon fiber surface treated recording to the process of this invention, when combined with matrix resin in a composite, provides better interface adhesion, as shown in Table II. From a comparison of the EDS data for the composites formed of un-treated fiber, Control A, and of singly-treated fibers, Control B and Control C, with the EDS data for the composites formed from Examples 1 and 2 fibers it will be apparent that these unexpected differences can be quite significant.

The invention will thus be seen to be surface-treated carbon fiber and an electrolytic process for surface treating carbon fiber wherein the fiber is first subjected as an anode to an oxidizer bath, then as anode to an ammonium bath.

The carbon fiber of this invention will further be seen to have a surface elemental nitrogen content greater than about 7% and a surface elemental nitrogen content of greater than about 4%. Composites made from said surface-treated carbon fiber exhibit improved interfacial bonding. Further additions and modifications of the invention will be readily apparent to those skilled in the art. The illustrative examples included herein are therefore not intended to be limiting of the invention, which is defined by the appended claims.

I claim:

1. A method of surface-treating carbon fibers comprising the steps of:

(a) moving the carbon fiber, as anode, through a first electrolytic bath comprising an aqueous solution of an oxidizer; then (b) moving said carbon fiber, as anode, through a second electrolytic bath comprising an aqueous solution of an ammonium compound, said bath having a pH of at least about 8.

2. The method of claim 1 wherein said oxidizer is an oxygen acid.

3. The method of claim 1 wherein said oxidizer is an oxygen acid selected from the group consisting of nitric acid, sulfuric acid and phosphoric acid.

4. The method of claim 1 wherein said oxidizer is present in from about 0.5 to about 20 wt %.

5. The method of claim 1 wherein said oxidizer is present from about 1 to about 10 wt %.

6. The method of claim 1 wherein said ammonium compound is ammonium hydroxide.

7. The method of claim 1 wherein the concentration of said ammonium compound is from about 0.02 M to about 5 M.

8. A method of surface-treating carbon fibers comprising the steps of:

(a) moving said fiber, as anode, through a first electrolytic bath comprising an aqueous solution of from about 0.5 to about 20 wt % nitric acid, followed by (b) moving said fiber, as anode, through a second electrolytic bath comprising from about 0.2 to about 5 M aqueous ammonium hydroxide.

9. A carbon fiber surface treated by the process of claim 8 and having a surface elemental content of at least 7% oxygen and at least 4% nitrogen.

* * * * *